US010292479B2

(12) United States Patent
Thiebaut et al.

(10) Patent No.: US 10,292,479 B2
(45) Date of Patent: May 21, 2019

(54) ARTICULATED APPLICATOR HAVING A FLEXIBLE STEM

(71) Applicant: L'Oreal, Paris (FR)

(72) Inventors: Laure Thiebaut, Clichy (FR); Pierre Ducastin, Villennes sur Seine (FR); Vincent Jacquart, Paris (FR); Michel Limongi, Clichy (FR); Marc Ramet, Tokyo (JP)

(73) Assignee: L'OREAL, Paris (FR)

( * ) Notice: Subject to any disclaimer, the term of this patent is extended or adjusted under 35 U.S.C. 154(b) by 71 days.

(21) Appl. No.: 15/120,141

(22) PCT Filed: Feb. 17, 2015

(86) PCT No.: PCT/EP2015/053276
§ 371 (c)(1),
(2) Date: Aug. 19, 2016

(87) PCT Pub. No.: WO2015/124550
PCT Pub. Date: Aug. 27, 2015

(65) Prior Publication Data

US 2017/0181524 A1 Jun. 29, 2017

(30) Foreign Application Priority Data

Feb. 21, 2014 (FR) ..... 14 51413

(51) Int. Cl.
*A46B 5/00* (2006.01)
*A45D 34/04* (2006.01)

(52) U.S. Cl.
CPC ..... *A45D 34/045* (2013.01); *A45D 34/04* (2013.01); *A46B 5/0058* (2013.01)

(58) Field of Classification Search
CPC ... A46B 5/0085; A46B 5/0087; A46B 5/0058; A45D 34/041; A45D 40/265; A45D 40/261
See application file for complete search history.

(56) References Cited

U.S. PATENT DOCUMENTS 4,165,755 A 8/1979 Cassai
5,816,728 A * 10/1998 Nardolillo ..... A45D 40/265 401/126
6,026,823 A 2/2000 Gueret
2004/0009028 A1 1/2004 Gueret
2008/0107470 A1 5/2008 Gueret
(Continued)

FOREIGN PATENT DOCUMENTS

EP 1917883 A2 5/2008
FR 2753056 A1 3/1998
(Continued)

OTHER PUBLICATIONS

International Search Report for PCT/EP2015/053276, dated Sep. 7, 2015.

*Primary Examiner* — David P Angwin
*Assistant Examiner* — Bradley S Oliver
(74) *Attorney, Agent, or Firm* — The Marbury Law Group, PLLC

(57) ABSTRACT

The subject of the present invention is an applicator for applying a product (P) to keratin materials, having:—an applicator element (5),—a stem (4),—a linking element (9) fixed to the stem (4),—an articulation (11).

9 Claims, 3 Drawing Sheets

(56) References Cited

U.S. PATENT DOCUMENTS

Figure 1:
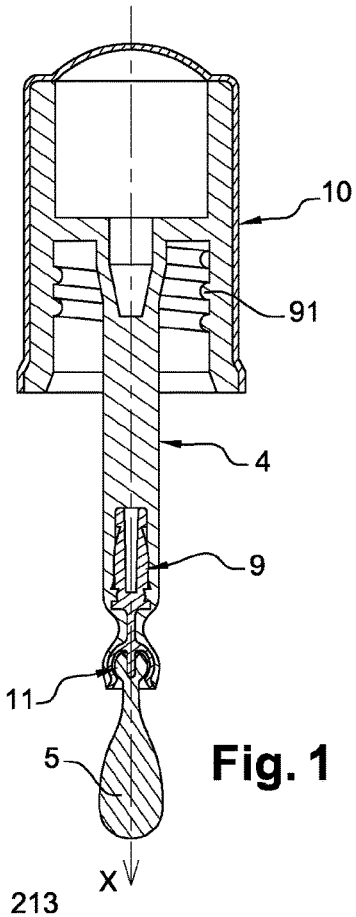

| | | | | |
|---|---|---|---|---|
| 2010/0313371 | A1* | 12/2010 | Kaczmarek ..... | A46B 5/0087<br>15/167.1 |
| 2015/0010340 | A1 | 1/2015 | Gueret | |

FOREIGN PATENT DOCUMENTS

| | | | |
|---|---|---|---|
| FR | 2840514 | A1 | 12/2003 |
| FR | 2908018 | A1 | 5/2008 |
| FR | 2979807 | A1 | 3/2013 |
| JP | 10-099127 | A | 4/1998 |
| WO | 2013/034638 | A1 | 3/2013 |
| WO | 2013/127740 | A1 | 9/2013 |

* cited by examiner

ARTICULATED APPLICATOR HAVING A FLEXIBLE STEM

CROSS REFERENCE TO RELATED APPLICATIONS

This is a national stage application of PCT/EP2015/053276, filed internationally on Feb. 17, 2015, which claims priority to French Application No. 1451413, which was filed on Feb. 21, 2014, both of which are herein incorporated by reference in their entireties.

The present invention relates to cosmetic applicators having a stem and a mobile applicator element.

Applicators in which the applicator element is orientable by the way of the stem are known.

Such applicators, which are suitable for the application of a cosmetic product, are described for example in FR 2 753 056, FR 2 840 514 and U.S. Pat. No. 4,165,755.

Applicators that are able to flex during the application of a cosmetic product to the skin are known. Thus, the documents FR 2 908 018 and FR 2 979 807, filed by the applicant, describe applicators having a stem that has at least one elastically deformable flexible portion. The applicator element is fixed to the flexible portion. A rigid holding element may be fixed inside or around the flexible portion. This holding element improves the precision of care or makeup application.

With such applicators, it is not always possible to achieve a completely satisfactory degree of comfort. In addition, they are not designed to massage an entire area of the face.

Applicators in which the applicator element is able to move as it is passed over a treated area have already been proposed. This ability to move is linked in particular to the inclination of the applicator element on the area in question and to the pressure exerted on this element by the user.

Such an applicator is described in the document WO 2013/127740. It has:

- a gripping member,
- a stem connected at its first end to the gripping member, and
- an applicator element connected to a second end of the stem by an articulation having a ball joint.

This applicator has notably the particular feature of being able to move with three degrees of freedom, depending on the actions carried out by the user. However, it does not systematically return into line with the stem when it is no longer in use. Its ability to move, in complete freedom, prevents the user from controlling its movement during massaging. Moreover, the travel of the applicator element is limited by the configuration of the articulation.

There is a need to further improve applicators for applying makeup to and caring for the skin, and to have a new applicator which is reliable, comfortable and easy to use.

In particular, there is a need to provide an applicator in which the applicator element:

- returns automatically to its rest position after use, and
- exhibits greater travel on either side of its rest position.

The applicator must also provide a pleasant and fluent massage, running smoothly over the area in question of the body. The movement must be able to be continuous, regular, and without jerks or jolts.

The applicator must be flexible and precise to handle. The user must be able to access all parts of the face easily and without constraint. It must also be able to lightly massage areas of the face that are more delicate or more marked by tiredness.

The present invention aims in particular to meet this need.

The subject of the invention is an applicator for applying a product (P) to keratin materials, having:

- an applicator element,
- a stem,
- a linking element fixed to the stem,
- an articulation, the linking element having an elastically deformable flexible portion that is able to flex during the application of the product to the keratin materials.

By virtue of the flexible portion, the applicator element systematically returns into line with the stem when it is no longer in use.

The presence of the flexible portion provides softness and tonicity for the application, even with a relatively rigid applicator element such as a metal ball for example.

Contact with the keratin materials is elastic, pleasant and comfortable.

Such an applicator can make it possible to change the orientation of the applicator element relative to the stem during use, without otherwise making it difficult to introduce the applicator into a container containing the product to be applied.

The flexible portion is capable of flexing in a reversible manner in order to change the orientation of the applicator element. The user thus feels a massaging effect with a new massaging hand movement.

The flexibility of the flexible portion can originate from its shape and/or the material or materials used to produce it.

The expression "elastically deformable" should be understood as meaning that the flexible portion has a certain shape memory. The expression "elastically deformable" should be understood to have a broad meaning and covers in particular the case in which the flexible portion, after having been deformed, returns by elasticity to a position which is not strictly identical to its initial position, taking into account, for example, the nature of the material used to produce the flexible portion and the shape thereof.

The term "articulation" should be understood as meaning an assembly of components, one of which comprises a physical axis or a ball joint for allowing an angular movement of the assembled components. The articulation ensures relative mobility of the components or the interlocking thereof in a fixed position.

The "axis of the articulation" is embodied as an axisymmetric component that serves to articulate one or more other components which describe a circular movement about it. Preferably, the axis of the articulation is perpendicular to the longitudinal axis of the applicator element. In particular, the axis of the pivot is perpendicular to the longitudinal axis of the applicator element. Thus, the movement of the applicator is controlled better. Preferably, the axis of the pivot is a rigid cylinder.

Stem

The stem may be in the form of a cylinder of revolution or approximately in the form of a cylinder of revolution, at least along the major part of its length. The stem may for example be other than flattened in a plane. The stem may for example have a length much greater than its width, for example more than two times, or even more than three times, better still more than five times greater than its width.

The stem may be fixed to a gripping member. In a variant, there may be an articulation between the stem and the gripping member.

Linking Element

The linking element is fixed to the stem.

The stem may have a housing for receiving one end of the linking element. In a variant, the linking element may have a housing for receiving one end of the stem. The linking element may have an enlarged head or a narrowing in order to improve the retention by the stem in the case of crimping.

Advantageously, the linking element is connected to the stem by snap-fastening, screw-connection, adhesive bonding, force-fitting or by crimping.

The linking element provides a spring effect for the applicator element.

It passes through a maximum degree of stress before being driven in a return movement.

The effect felt by the user is a dynamic and stimulating massaging effect.

Flexible Portion

The flexible portion may extend along a rectilinear or non-rectilinear longitudinal axis, this axis being for example in line with that of the applicator element when the applicator is at rest.

The flexible portion may be produced by moulding, for example by injection-moulding of thermoplastic material. It is possible in particular for the flexible portion not to be embossed.

The flexibility of the flexible portion may be chosen depending on the properties desired for application, for example by virtue of the choice of material or materials of which it is made, in particular their Shore hardness.

The flexible portion may be produced at least partially from a material from the following list: elastomeric material, thermoplastic, thermoplastic elastomer, LDPE, PVC, PU, thermoplastic polyester elastomers, in particular copolymers of butene terephthalate and esterified polytetramethylene oxide glycol, Hytrel®, EPDM, PDM, EVA, SIS, SEBS, SBS, latex, silicone, nitrile, butyl, polyurethane, polyether-block-amide, polyester, this list not being limiting.

The flexible portion may be produced with a material having a hardness of for example between 25 Shore A and 80 Shore D, or even between 40 Shore A and 70 Shore D. Preferably, the flexible portion will have a hardness of 60 to 80 Shore A.

The total visible length l of the flexible portion is for example between 7 and 25 mm. A greatest external transverse dimension of the flexible portion is for example between 3 and 20 mm, ideally between 5 and 10 mm.

Preferably, the flexible portion has a greatest external transverse dimension that is equal to a greatest transverse dimension of the stem.

The flexibility of the flexible portion may vary depending on the cross section and on the profile of the flexible portion.

The flexible portion may have a solid or hollow cross section having a varied shape, for example a shape chosen from the following list: polygonal, square, rectangular, triangular, circular, non-circular, oblong, oval, elliptical, crenellated, star-shaped, having one or more annular or axial grooves.

The flexible portion may be rotationally symmetrical about the longitudinal axis of the stem.

The flexible portion may have a narrowing, if need be. This narrowing may be annular in shape. It is in the region of this narrowing that the articulation is able to move in rotation or as a ball joint depending on its geometry.

It is possible for the flexible portion not to be rotationally symmetrical. Such a shape may make it possible to obtain flexibility which is variable in the inclination direction of the applicator element with respect to its initial configuration.

Advantageously, the flexible portion may be inclined in a reversible manner by more than 30°, or even more than 45°, or even more than 60°, with respect to an initial rest configuration in which the applicator element and the stem are aligned. The inclination could be limited by the geometry of the flexible portion.

Rigid Portion

Advantageously, the linking element has a rigid portion.

The expression "rigid portion" should be understood as meaning a part which only deforms under the action of a medium to significant force. A rigid portion may undergo a slight overall deformation in the event of an exerted force.

The rigid portion may be produced from a thermoplastic material, in particular one of the materials chosen from the following list: HDPE, LDPE, linear PE, PT, PP, POM, PA, PET, PBT, this list not being limiting.

The rigid portion may have a solid or hollow cross section having a shape chosen from the following list: circular, non-circular, oblong, oval, elliptical, polygonal, square, rectangular, triangular, kidney-shaped, crenellated, star-shaped, having one or more grooves. A circular cross section may be preferred.

The rigid portion may have at least one housing for fixing the flexible portion thereto.

Advantageously, the flexible portion is overmoulded on the rigid portion.

Preferably, the rigid portion forms the core of the linking element.

Applicator Element

The applicator element may have a massage element having a more or less smooth external surface. In a variant, the external surface may also be provided with irregularities, such as sculptures in relief, in particular if the massage is carried out in order to abrade epidermal tissue.

Preferably, the applicator element is able to move under the effect of a force of between 0 N and 0.4 N, preferably between 0.01 N and 0.02 N.

Advantageously, there is no rubbing or friction between the applicator element and the seat.

The applicator element may have the form of a sphere, of a pearl, of a fine brush, of a brush, of a spatula, of a massage plate having rigid or flexible reliefs, of a massage plate having fixed or movable elements such as a roll on, of a rugby ball or of a tear.

More preferably, the applicator element is in one piece.

The applicator element is made in particular of metal, such as stainless steel, of ceramic, of glass, of elastomer, or of plastics material. It may comprise at least two materials. For example, it may be made of flocked plastics material, of plastics material carrying a sponge or of two materials, one flexible and one rigid.

Advantageously, the applicator element is made of metal. It provides a sensation of freshness, which improves the well-being and relaxation of the person, which makes it possible to reduce puffiness at or decongest a contour of the eyes, for example, while increasing the effectiveness of the product applied.

The applicator element may also comprise a porous material, for example a foam, a sponge, a felt or a flocked end piece, being designed for example to apply a product to the body or the face. It holds more product and releases it progressively.

The applicator element may be able to hold product by capillary action.

The applicator element may have a rectilinear or curved axis, and preferably the axis is rectilinear in order to adapt better to the articulation.

Articulation

Advantageously, the articulation connects the applicator element to the linking element. Hand movements are thus optimized.

According to a first embodiment of the invention, the articulation allows relative mobility of the applicator element and the linking element. The applicator makes it possible to reach more confined locations on the face or the body.

According to a second embodiment of the invention, the articulation allows the applicator element and the linking element to be interlocked in a fixed position. The applicator is easy to move over a wide area. It moves as one with the stem.

According to a third embodiment, the articulation comprises a ball joint.

Within the meaning of the invention, a "ball joint" is understood as meaning an articulation which is formed in one part, is preferably spherical and can rotate in a hollow housing. In particular, the spherical component may be chamfered.

The ball joint linkage is identified by its degrees of freedom: it completely links two components in translational movement but leaves them free to rotate. It has three degrees of linkage (the three translational movements) and three degrees of freedom (the three rotational movements). The simplest case is that of two, male and female, spheres. There is no preferred direction from the point of view of behaviour. There is only one schematic representation, in as much as no direction can be distinguished. When two components are linked by a ball joint, there is a fixed point on one component that coincides with a fixed point on the other. This point is the centre of the linkage.

According to a fourth embodiment, the articulation comprises a pivot.

The "ball joint linkage" is distinguished from the "pivot linkage". The latter guides a component in rotation, only allowing rotation about the axis of the linkage. When two solids are in a pivot linkage, there are at least two fixed points on each solid that coincide in each case. The straight line passing through these points constitutes the axis of the linkage. It comprises three degrees of linkage (the three translational movements) and a single degree of freedom (one rotational movement).

Advantageously, the articulation is disposed inside the linking element.

Disposing the articulation inside the linking element can make the applicator more compact and easier to handle.

Preferably, the articulation is configured to prevent axial or lateral movement of the applicator element relative to the linking element in the region of the articulation.

The absence, in the region of the articulation, of axial or lateral movement of the applicator element relative to the linking element allows the user to precisely position the applicator element at the desired location.

Packaging and Application Devices

A further subject of the invention is a device for packaging and applying a cosmetic product, having a container containing the product and an applicator as defined above.

The applicator may be configured to close the container.

The container may be a tube, a pot or a bottle, for example.

The applicator element may dip into the container.

The container may have a wiper. Sealed closure of the container may be obtained by a seal located at the top of the stem. The cosmetic product may be in particular a body care product or a facial care product, a makeup product or a hygiene product. In particular, the cosmetic product may be a moisturizing care product, an anti-ageing product, an anti-wrinkle product, a foundation, a gloss, a lip balm, a lipstick, an eyeshadow, a concealer, an anti-cellulite care product or a mascara.

Application Method

A further subject of the invention is a method for applying a cosmetic product to keratin materials, having the following steps of:

- loading the applicator element of an applicator as defined above with a cosmetic product,
- bringing the applicator element into contact with the keratin materials,
- moving the applicator so as to apply the product to the keratin materials,
- modifying the orientation of the applicator element with respect to the stem by changing the pressure exerted on this element, so as to massage the keratin materials.

When the applicator element is configured to apply a product to a particularly sensitive area, such as an eye contour area, the method may have the following steps of:

- positioning the end of the applicator element such that it rests under one eye,
- with the applicator element at a first inclination in relation to the stem, rotating the applicator element about a first axis, in particular an axis perpendicular to the area,
- with the applicator element at a second inclination, different from the first, in relation to the stem, rotating the applicator element about a second axis, in particular an axis not perpendicular to the area,
- modifying the resting point.

Figure 2:
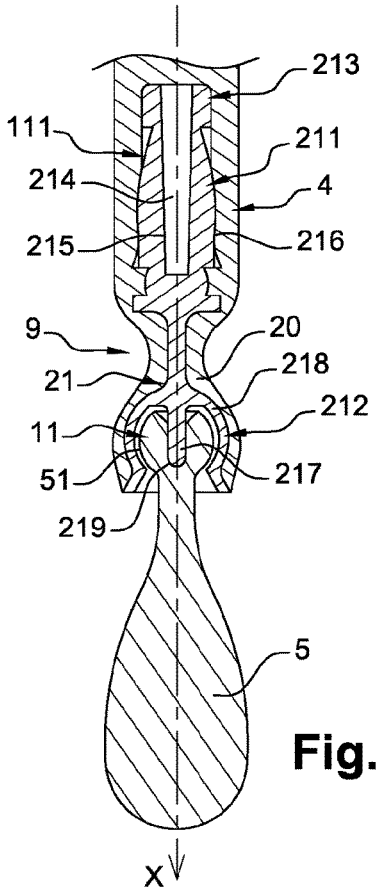
Figure 3:
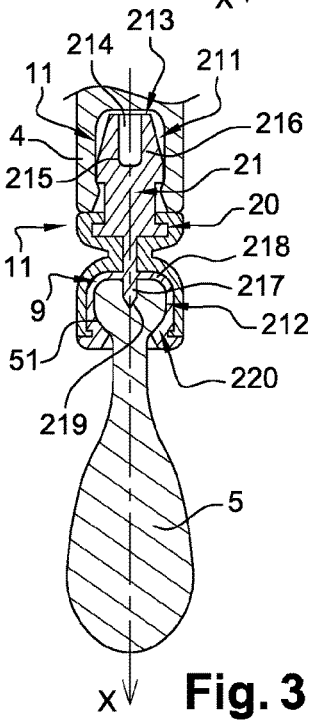
Figure 4:
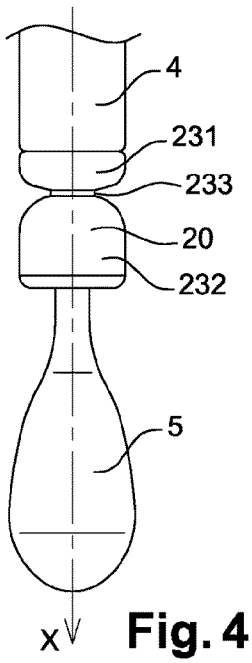
Figure 5:
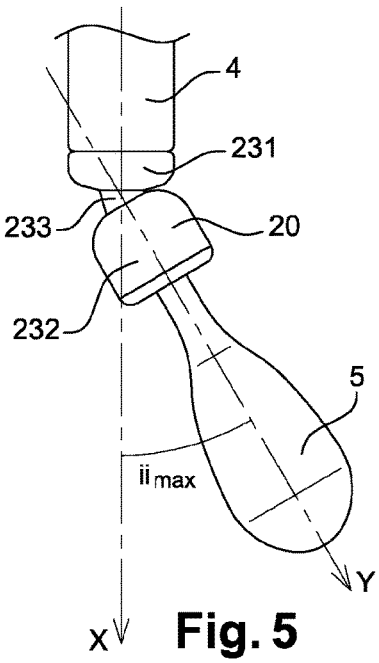
Figure 6:
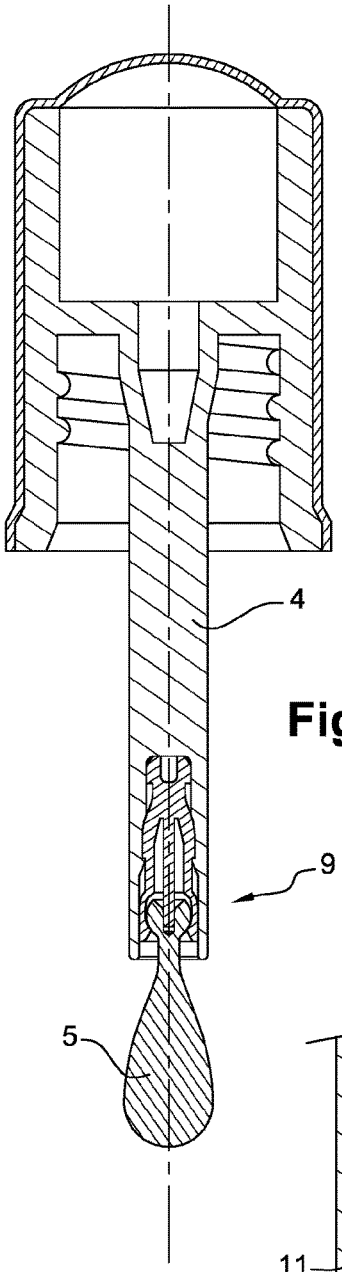
Figure 7:
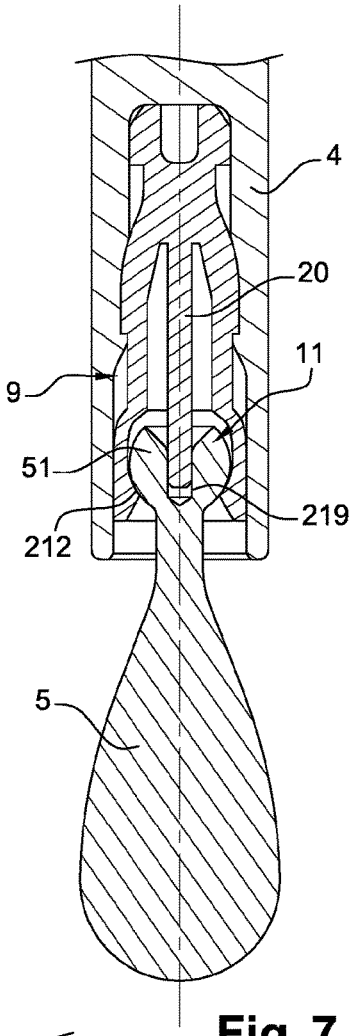
Figure 8:
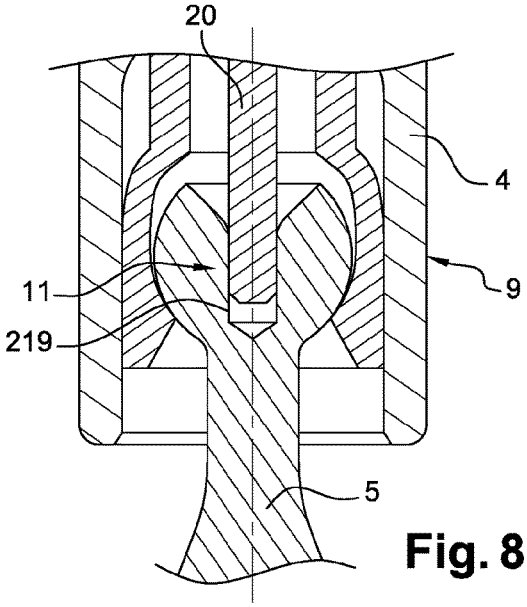
Figure 9:
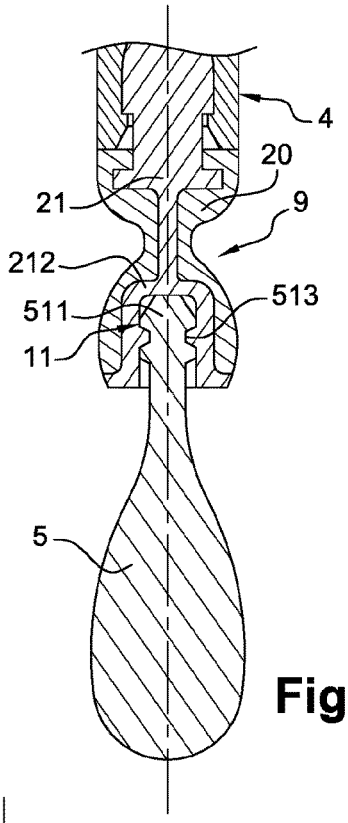
Figure 10:
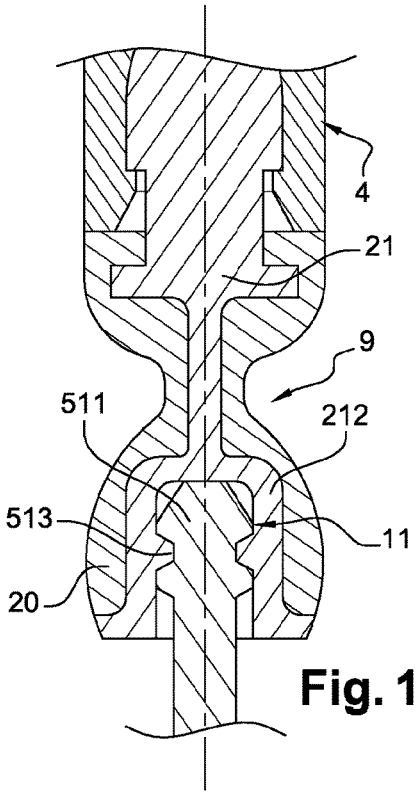
Figure 11:
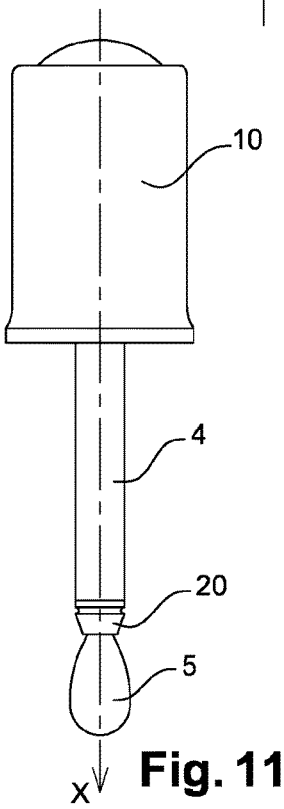
Figure 12:
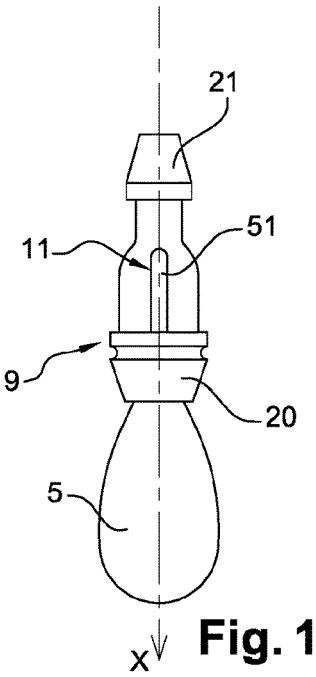
Figure 13:
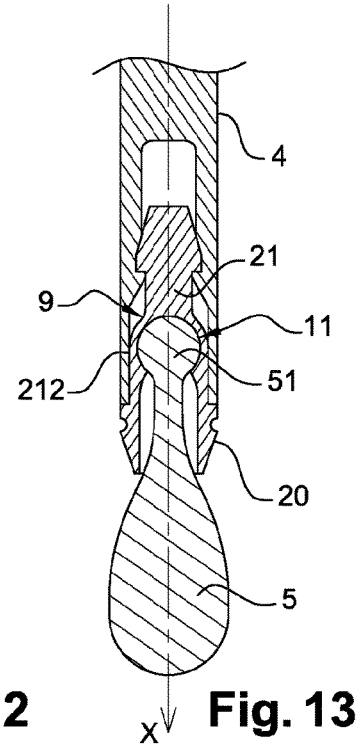

The invention may be better understood from reading the following detailed description of non-limiting implementation examples and from examining the appended drawing, in which:

FIG. 1 is a schematic view, in axial section, of a first example of an applicator according to the invention, FIG. 2 schematically and partially shows a magnification of the linking element of the device from FIG. 1 in axial section, FIG. 3 is a schematic view, in partial axial section, of a second example of an applicator according to the invention, FIG. 4 schematically and partially shows a front view of the applicator from FIG. 3, in the rest position, FIG. 5 schematically and partially shows a front view of the applicator from FIG. 3, following rotation of the applicator element in relation to the stem, in the position of maximum inclination, FIG. 6 is a schematic elevation view, in partial axial section, of a third example of an applicator according to the invention, FIG. 7 schematically and partially shows the linking element of the device from FIG. 6 in axial section, FIG. 8 schematically and partially shows the articulation of the device from FIG. 6 in axial section, FIG. 9 is a schematic view, in axial section, of a fourth example of an applicator according to the invention, FIG. 10 schematically and partially shows a magnification of the linking element of the device from FIG. 9 in axial section, FIG. 11 is a schematic front view of a fifth example of an applicator according to the invention, FIG. 12 schematically and partially shows a front view of a magnification of the linking element of the device from FIG. 11, FIG. 13 schematically and partially shows a magnification of the linking element and a stem portion of the device from FIG. 11 in axial section.

FIRST APPLICATOR EXAMPLE

The applicator shown in FIGS. 1 and 2 is intended for the application of a product P to the face or the body, for example a moisturizing cream.

The applicator has a stem 4, a gripping member 10 and an applicator element 5. The stem 4, the linking element 9 and the applicator element 5 can be aligned along the same longitudinal axis X. The gripping member 10 constitutes a closure cap for a container. To this end, it is provided with an internal thread 91 configured to be screwed onto a threaded neck of the container.

The applicator also has an articulation 11.

The applicator element 5 is made of metal.

In the example in question, the stem 4 has a rectilinear longitudinal axis X which is approximately coincident with the axis of the neck of the container when the applicator is in place on the latter.

A linking element 9 is fixed to the distal end of the stem 4. This fixing is produced by force-fitting or clip-fastening.

The linking element 9 has:

a flexible outer portion 20, and a rigid inner portion 21.

The flexible portion 20 is made of a material more flexible than that of the rigid portion 21. For example, the flexible portion 20 is produced from a material from the following list: elastomeric material, thermoplastic, thermoplastic elastomer, LDPE, PVC, Hytrel®, EPDM, EVA, SIS, SEBS, SBS, latex, silicone, nitrile, butyl, polyurethane, polyether-block-amide.

The rigid portion 21 is produced for example from a polyolefin (PP).

The rigid portion 21 is produced for example from POM or PBT.

The flexible portion 20 confers flexibility on the stem 4.

At the time of application, the contact between the applicator element 5 and the skin is softened and the elasticity of the flexible portion 20 proves to be beneficial for the application of the product.

The rigid portion 21 may be fixed to the stem 4 in various ways. It may for example be force-fitted into a housing 211 in the stem 4, as illustrated in FIG. 3.

On the other side, the rigid portion 21 has a housing 212 for receiving one end of the applicator element 5.

The rigid portion 21 has a line 210 connecting the area for fixing in the stem 213 and the housing 212 for receiving the applicator. This line 210 is the area allowing the articulation. If this line has a rotationally symmetrical shape, the articulation is a ball joint. If this line has a flat shape like a lamella, the articulation is a pivot. When the linking element is inclined, the rotation causes the line 210 to flex. This line 210 then exerts an opposing force which tends to return the linking element into its starting position.

Regardless of the load exerted on the linking element, it returns to its rest position as soon as this load ceases.

New hand movements for massaging and applying makeup, which were not conceivable with conventional applicators, are obtained.

The line 210 acts as a spring for a new massaging hand movement using tapping and pressure.

Of course, various modifications can be made to the applicator and in particular to the applicator element and to the flexible portion without departing from the scope of the present invention.

The flexible portion 20 can be fixed to the rigid portion 21 in various ways.

At its first axial end, the rigid portion 21 can have a head 213 of axis X. The head 213 is inserted into the housing 211 in the stem 4. It may for example comprise an end part 211 having flat faces 215 and 216 which are substantially parallel to the axis X and through which an opening 214 passes. These faces 215 and 216 narrow at the end so as to provide a better linkage to the stem 4. The housing in the stem 211 has notches in its internal part, allowing 213 and 211 to be clip-fastened.

At its second axial end, the rigid portion 21 can have a spherical wall 218. The latter can define a housing 212 for receiving a spherical portion 51 of the applicator element 5. The wall 218 can have a central protrusion 217. It can be inserted into a corresponding housing 219 in the portion 51. The central protrusion 217 makes it possible to keep the applicator in line with the stem at rest in the case of a ball joint linkage between the linking element and the applicator.

The spherical portion 51 is force-fitted in the housing 212 with the desired clearance. The housing 212 delimits a skirt 220 intended to cover the spherical end 51 so as to prevent intentional or unintentional disassembly of the applicator.

The rigid portion 21 is only inserted partially into the stem 4.

The linking element 9 is partially visible.

The linking element 9 shown in FIG. 3 is substantially identical to the one shown in FIG. 2, but the depth of penetration of the rigid portion 21 into the stem 4 is less.

The linking element 9 can be connected to the applicator element 5 by a ball joint articulation 11, by a pivot or be fixed.

The articulation 11 has the spherical portion 51 and the housing 212 defining the seat of the articulation. Such a ball joint allows the applicator element 5 to rotate on itself, about its axis X, in relation to the stem 4. Of course, the rotation can be clockwise or anticlockwise.

The axis Y of the linking element can be inclined with respect to the axis X of the stem.

The angle ii formed between the axis X of the stem 4 and the axis Y of the applicator element can be modified by the user, as shown in FIGS. 4 and 5.

If the applicator element also has an articulation with the linking element, the axis Z of the applicator element can be inclined with respect to the axis Y of the linking element.

The flexible portion 20 partially covers the rigid portion 21.

When the flexible portion completely covers the rigid portion 21, this does not depart from the scope of the present invention.

In FIG. 4, it is possible to see that the flexible portion 20 comprises a visible part which has:

a collar 231 covering the end of the rigid portion 21, a narrowing 233, a collar 232 covering the spherical portion 51.

As illustrated in FIG. 5, the collar 232 comes into abutment against the collar 233 during the rotational movement of the applicator element 5.

This abutment limits the movement of the applicator element 5. It defines the maximum possible inclination of the applicator.

The abutment is realized by the impact of two flexible components. The impact is soft and cushioned. The sensation of flexibility felt by the user is pleasant.

When the maximum angle ii max is reached (FIG. 5), the applicator element 5 returns systematically to its central rest position (FIG. 4).

SECOND APPLICATOR EXAMPLE

The applicator shown in FIGS. 6 to 8 has a linking element 9 entirely housed in the stem 4.

The linking element 9 has a flexible line 20 passing into the housing 219 of the applicator element 5. The housing 219 forms a relatively deep cavity.

The ball joint articulation 11 is housed entirely inside the stem 4.

The spherical part 51 is mounted with the desired clearance in the housings 212 and 219.

When the applicator element 5 is inclined, the rotation of the spherical part 51 causes the line 20 to flex. This line 20 then exerts an opposing force which tends to return the spherical part 51 into its starting position.

Regardless of the load exerted on the applicator, it returns to its rest position as soon as this load ceases.

New hand movements for massaging and applying makeup, which were not conceivable with conventional applicators, are obtained.

The flexible portion 20 acts as a spring for a new massaging hand movement using tapping and pressure.

The applicator element 5 can have a texturized surface so as to enhance the massaging function and the retention of the cosmetic product.

In order to use the applicator, the person loads the applicator element 5 with the product.

She brings the applicator element 5 into contact with the skin. She moves the applicator element 5 over the skin. She can stop at certain locations and rotate the applicator element 5 on itself. She thus carries out a practically point-like massage by pressure at a location she has chosen, for example for its sensitivity.

She can also incline the axis of the applicator element 5 with respect to the axis of the stem 4. The applicator element 5 is automatically returned to its rest position if the inclination becomes too great.

THIRD APPLICATOR EXAMPLE

The applicator shown in FIGS. 9 and 10 has an applicator element 5 fixed in the linking element 9. In this example, the articulation 11 ensures that the applicator element 5 and the linking element 9 are interlocked in a fixed position. The articulation 11 makes it easier to mount the applicator element in the linking element.

The articulation 11 has:

a portion 511 in the form of a harpoon, and a housing 212 defining the seat of the articulation.

The portion 511 is mounted in the housing 212 by inserting the harpoon into the seat 511. The two components are secured together with a tight fit. The portion 511 defines a clip-fastening notch 513 for snap-fastening the applicator element 5 in the linking element 9.

In order to use the applicator, the person loads the applicator element 5 with the product.

She brings the applicator element 5 into contact with the skin. She moves the applicator element 5 over the skin. She can also incline the axis of the applicator element 5 with respect to the axis of the stem 4. The applicator element 5 is automatically returned to its rest position if the inclination becomes too great. This return to the rest position is allowed on account of the spring effect of the flexible element 20.

FOURTH APPLICATOR EXAMPLE

The applicator shown in FIGS. 11 to 13 has a linking element 9 formed by two-shot injection moulding with a rigid top part 21 and a flexible bottom part 20. The applicator is clip-fastened in the stem 4. When it is pivoted by pressing against the skin, the latter stretches the flexible part 20, which automatically returns the applicator element 5 into its axis X when the pressure on the applicator element 5 ceases. The articulation 11 ensures relative mobility of the applicator element 5 and the linking element 9. Furthermore, the flexible portion 20 ensures that the axis of the applicator element 5 flexes with respect to the axis of the stem 4. The applicator element 5 is automatically returned to its rest position if this inclination becomes too great. This return to the rest position is allowed on account of the spring effect of the flexible element 20.

Of course, the invention is not limited to the exemplary embodiments that have just been described. The features of the different embodiments can for example be combined with one another in order to produce new embodiments in accordance with the invention. In particular, the applicator element may be different. The composition of the linking element and its arrangement with respect to the stem may be different. The articulation could be of any other kind.

The invention also relates to an applicator for applying a product to keratin materials, having:

an applicator element, a stem, a linking element fixed to the stem, this linking element defining a narrowing, said linking element having an elastically deformable flexible portion that is able to flex during the application of the product to the keratin materials and a rigid portion, said rigid portion passing through said narrowing.

The expression "having a" should be understood as being synonymous with "having at least one", unless specified to the contrary.

The invention claimed is:

1. An applicator for applying a product to keratin materials, comprising:

an applicator element;

a stem;

a linking element fixed to the stem; and an articulation comprising a ball joint, wherein the linking element comprises:

a rigid portion having a housing for receiving a portion of the applicator element; and an elastically deformable flexible portion overmolded on the rigid portion, wherein the flexible portion is configured to flex during the application of the product to the keratin materials;

wherein the applicator element comprises a massage element having a substantially smooth outer surface configured to contact the keratin materials, and wherein the applicator element is formed as a single piece made of metal, ceramic, or glass.

2. The applicator according to claim 1, wherein the articulation is configured to connect the applicator element to the linking element.

3. The applicator according to claim 1, wherein the articulation is configured to allow relative mobility of the applicator element and the linking element.

4. The applicator according to claim 1, wherein the articulation is configured to allow the applicator element and the linking element to be interlocked in a fixed position.

5. The applicator according to claim 1, wherein the articulation is disposed inside the linking element.

6. The applicator according to claim 1, wherein the articulation is configured to prevent axial or lateral movement of the applicator element relative to the linking element in the region of the articulation.

7. The applicator according to claim 1, wherein the linking element is connected to the stem by snap-fastening, screw-connection, adhesive bonding, force-fitting, or crimping.

8. A container comprising:

a cosmetic product, and an applicator for applying the cosmetic product, said applicator comprising:

an applicator element;

a stem;

a linking element fixed to the stem; and an articulation comprising a ball joint, wherein the linking element comprises:

a rigid portion having a housing for receiving a portion of the applicator element; and an elastically deformable flexible portion overmolded on the rigid portion, wherein the flexible portion is configured to flex during the application of the product to the keratin materials;

wherein the applicator element comprises a massage element having a substantially smooth outer surface configured to contact the keratin materials, and wherein the applicator element is formed as a single piece made of metal, ceramic, or glass.

9. A method for applying a cosmetic product to keratin materials, comprising:

loading the cosmetic product onto an applicator element of an applicator, wherein the applicator comprises:

the applicator element;

a stem;

a linking element fixed to the stem; and an articulation comprising a ball joint, wherein the linking element comprises:

a rigid portion having a housing for receiving a portion of the applicator element; and an elastically deformable flexible portion overmolded on the rigid portion, wherein the flexible portion is configured to flex during the application of the product to the keratin materials;

wherein the applicator element comprises a massage element having a substantially smooth outer surface configured to contact the keratin materials, and wherein the applicator element is formed as a single piece made of metal, ceramic, or glass;

bringing the applicator element into contact with the keratin materials;

moving the applicator over the keratin materials; and modifying the orientation of the applicator element with respect to the stem by changing the pressure exerted on the applicator element.

* * * * *